US005627576A

United States Patent [19]

Inui et al.

[11] Patent Number: 5,627,576

[45] **Date of Patent: *May 6, 1997**

[54] INK JET HEAD USING EXCITED PROGRESSIVE WAVES

[75] Inventors: Tetsuya Inui, Nara; Susumu Hirata, Ikoma-gun; Yorishige Ishii, Yamatotakada; Kenji Ohta, Kitakatsuragi-gun; Kazuhiro Kimura, Sakai, all of Japan

[73] Assignee: Sharp Kabushiki Kaisha, Osaka, Japan

[ * ] Notice: The term of this patent shall not extend beyond the expiration date of Pat. No. 5,491,500.

[21] Appl. No.: 551,768

[22] Filed: Nov. 7, 1995

Related U.S. Application Data

[62] Division of Ser. No. 183,410, Jan. 19, 1994, Pat. No. 5,491,500.

[30] Foreign Application Priority Data

Jan. 22, 1993 [JP] Japan ..... 5-09436

[51] Int. Cl.[6] ..... B41J 2/065

[52] U.S. Cl. ..... 347/48; 347/68

[58] Field of Search ..... 347/40, 48, 68, 347/70

[56] References Cited

U.S. PATENT DOCUMENTS

| | | | |
|---|---|---|---|
| 4,282,532 | 8/1981 | Markham | 347/75 X |
| 4,293,865 | 10/1981 | Jinnai et al. | 347/48 |
| 4,703,333 | 10/1987 | Hubbard | 347/40 |
| 5,126,615 | 6/1992 | Takeuchi et al. | 347/68 X |
| 5,144,342 | 9/1992 | Kubota | 347/72 |
| 5,265,315 | 11/1993 | Hoisington et al. | 347/68 X |
| 5,491,500 | 2/1996 | Inui et al. | 347/48 |

FOREIGN PATENT DOCUMENTS

| | | | |
|---|---|---|---|
| 0430087A2 | 6/1991 | European Pat. Off. . | |
| 54-12838 | 1/1979 | Japan . | |
| 55-43258 | 3/1980 | Japan . | |
| 63-37957 | 2/1988 | Japan . | |
| 63-91258 | 4/1988 | Japan . | |
| 1-64856 | 3/1989 | Japan . | |
| 2-258348 | 10/1990 | Japan . | |
| 2-269058 | 11/1991 | Japan | B41J 2/015 |
| 4-284253 | 10/1992 | Japan . | |

OTHER PUBLICATIONS

Capelletti, W. et al.; "Partitioned Drop–On–Demand Generator," IBM Technical Disclosure Bulletin, vol. 26, No. 9, Feb. 1984, pp. 4542–4543.

Patent Abstracts of Japan, vol. 12, No. 36 (M–664) 3 Feb. 1988 & JP–A–62 189 168 (NEC CORP).

Patent Abstracts of Japan, vol. 14, No. 69, (M–0932) 8 Feb. 1990 & JP–A–01 288 453 (CANON INC.).

Patent Abstracts of Japan, vol. 13, No. 140, (M–810) 6 Apr. 1989 & JP–A–63 303 752 (NEC CORP).

"A Piezo–electric Actuator Using Functionally Gradient Material" (Technical Report of Yokogama Electric Works, Ltd. vol. 35, No. 4, 1981), published Oct. 20, 1991.

"Fundamental Consideration on Excitation of Flexural Progressive Wave" (IEIEC Technical Report, US86–16, published on Jul. 4, 1986), Tomikawa et al., Faculty of Engineering, Yamagata University.

*Primary Examiner*—Benjamin R. Fuller
*Assistant Examiner*—Charlene Dickens
*Attorney, Agent, or Firm*—Nixon & Vanderhye P.C.

[57] ABSTRACT

An ink jet head has an ink head main body that is constituted of a substrate, spacers that are formed on one side of the substrate, and a roof plate that is joined to the substrate through the spacers. One or more ink passages are independently formed between the substrate and the roof plate. Rows of piezoelectric devices, each of which is made of a plurality of piezoelectric devices aligned along each ink passage, are formed through the respective ink passages. Ac voltages whose phases are different from each other by 90 degrees are applied to the respective piezoelectric devices. Progressive waves, which are excited by the rows of piezoelectric devices, allow ink to move through the ink passage and to be sprayed.

2 Claims, 18 Drawing Sheets

INK JET HEAD USING EXCITED PROGRESSIVE WAVES

This is a divisional of application Ser. No. 08/183,410, filed Jan. 19, 1994 U.S. Pat. No. 5,491,500.

FIELD OF THE INVENTION

The present invention relates to an ink jet head for use in ink jet printers or other apparatus wherein recordings are made by spraying ink in a mist state onto a sheet of paper.

BACKGROUND OF THE INVENTION

In response to recent outstanding developments in computers and like apparatuses, a new technology has been developed as a means for visualizing output information from those apparatuses, wherein ink in a mist state is sprayed so as to adhere onto a sheet of recording paper, thereby allowing letters and pictures to be recorded thereon. Ink jet printers using this technology provide a low noise printer that enables recording on ordinary paper as well as color printing.

Among the ink jet heads used in such ink jet printers, the thermal type is known. FIG. 16 shows the ink head main body 501 of the ink jet head of the thermal type. A nozzle 503 is fixed to one end of the ink head main body 501. The top portion of the nozzle 503 is connected to an orifice 502, and the other end of the nozzle 503 is connected to an ink storage section 505. An ink supply section, not shown, is connected to the ink storage section 505 through an ink inlet 504, and ink is supplied from the ink supply section through the ink inlet 504. A heater section 506 is installed in the proximity of the nozzle 503, and ink inside the ink storage section 505 is heated by the heater section 506 to vaporize abruptly. The resulting vapor pressure thus produced allows ink particles to be sprayed from the orifice 502.

In this method, however, it is necessary to heat the heater section 506 instantaneously to a high temperature in the vicinity of 1000° C. upon spraying the ink particles; this results in a problem in the life of the heater section 506.

In order to solve this problem and to provide an ink jet head having a long life, a piezoelectric type has been developed. The ink jet head of this type is provided with a piezoelectric device 507, shown in FIG. 17, which mechanically oscillates in response to electric signals. In the ink jet head of this type, the ink jet head main body 510 has an orifice 502, and a piezoelectric device 507 is installed in an ink storage section 508 that connects the orifice 502 and the ink inlet 504. When the piezoelectric device 507 is driven, the volume of the ink storage section 508 is decreased, thereby increasing the pressure inside the ink storage section 508. This high pressure is applied to ink 509, thereby forcing ink particles 509*a* to be sprayed from the orifice 502.

In order to design a compact ink jet head having a high degree of integration, it is possible to achieve the objective by employing a well established, fine machining technique such as the etching method and other methods, if other conditions permit the application of the technique. In the above arrangement, however, the spraying force of the ink 509*a* is obtained through the mechanism wherein upon spraying ink, the volume of the ink storage section 508 is decreased to a size as small as the volume of the ink particles 509*a*. Therefore, it is necessary to provide a piezoelectric device 507 which is bigger than a predetermined size. This makes it difficult to design a compact ink jet head having a high degree of integration.

Moreover, the ink particles 509*a* are sprayed by the increased inner pressure of the ink storage section 508; therefore, once air (bubbles) enters the ink storage section 508, the bubbles are only pressurized by the driving operation of the piezoelectric device 507 even if the volume of the ink storage section 508 is decreased. This results in insufficient pressure to be applied to the ink 509, causing a problem in reliability due to difficulty in spraying the ink 509.

Japanese Laid-Open Patent Application No. 269058/1990 (Tokukaihei 2-269058) discloses a liquid-spraying apparatus wherein a force exerted by progressive waves is utilized. The apparatus is provided with, for example, tandem-type electrodes and reflectors that are installed on a substrate. Progressive waves occur in response to electric signals sent to the substrate from the tandem-type electrodes, and when liquid is imposed on the progressive waves, part of the liquid becomes mist and flies.

However, since the above liquid-spraying apparatus has a complicated structure, it cannot be produced by a batch process that uses the etching method or other methods. Consequently, it is difficult to make the apparatus compact, and the production cost of the apparatus is expensive.

Further, in order to spray the liquid in an appropriate direction, for each operation, it is necessary to provide preparatory work for accurately adjusting various factors such as frequency and voltage in ac electric signals, frequency and its duty ratio in pulse signals, angles made between the reflector and the substrate, etc. in accordance with the quantity and characteristics of the liquid.

SUMMARY OF THE INVENTION

It is an objective of the present invention to provide a compact ink jet head which has a high degree of integration as well as high reliability.

It is another objective of the present invention to provide an ink jet head which achieves a simple structure and a low manufacturing cost.

In order to achieve the above objectives, the ink jet head of the present invention includes an ink jet main body, and a nozzle from which ink is sprayed and an ink passage that is connected to the nozzle are formed in the ink jet main body. Further, a row of piezoelectric devices is formed along the ink passage in the flowing direction, and ac voltages having different phases are applied to the row of piezoelectric devices. The ink jet head of the present invention is characterized by a construction wherein a head device, which is one unit for ink spraying, is constituted of the nozzle, the ink passage, and the row of piezoelectric devices.

In accordance with the above construction, progressive waves are excited in the flowing direction toward the nozzle by applying ac voltages having different phases to the row of piezoelectric devices. The progressive waves impart a velocity in the flowing direction toward the nozzle to ink located inside the ink passage, and move the ink through the ink passage toward the nozzle, thereby allowing it to be sprayed from the nozzle as ink particles.

Therefore, even if bubbles enter the ink passage, the bubbles are carried following the ink flow, and discharged from the nozzle; this prevents the bubbles from interfering with the ink spray, which makes the present construction different from conventional constructions. Thus, it becomes possible to obtain an ink jet head having high reliability.

Further, different from the conventional usage of piezoelectric devices, the above row of piezoelectric devices are not used to change the volume of the ink storage section, but instead used to excite the progressive waves. For this reason, no limitation is imposed in miniaturizing the piezoelectric devices. This makes it possible to miniaturize the ink jet head, and to produce an ink jet head having a high degree of integration.

Moreover, the ink passage allows ink to be led to the nozzle accurately as well as easily, and the nozzle also allows ink particles to reach and adhere to a desired printing position accurately as well as easily. Therefore, it is not necessary to provide preparatory work for adjusting factors such as the moving direction of ink and the moving direction of ink particles in accordance with the quantity and properties of the ink.

Furthermore, the ink jet head of the present invention, which has a simple construction as described above, can be produced in a large quantity through a batch process by adopting a fine machining technique such as the etching method. This makes it possible to miniaturize the device as well as to reduce the cost of production.

BRIEF DESCRIPTION OF THE DRAWINGS

FIG. 1(*b*) is a vertical cross-sectional view of the ink head main body of the ink jet head.

FIG. 5(*b*) is a plan view showing a pattern of the piezoelectric devices.

FIG. 9(*b*) is an explanatory drawing showing a state wherein the ink head main body, shown in FIG. 9(*a*), is in operation.

DETAILED DESCRIPTION OF THE PREFERRED EMBODIMENTS

[Embodiment 1]

Referring to FIGS. 1 through 8, the following description will discuss one embodiment of the present invention.

Figure 1:
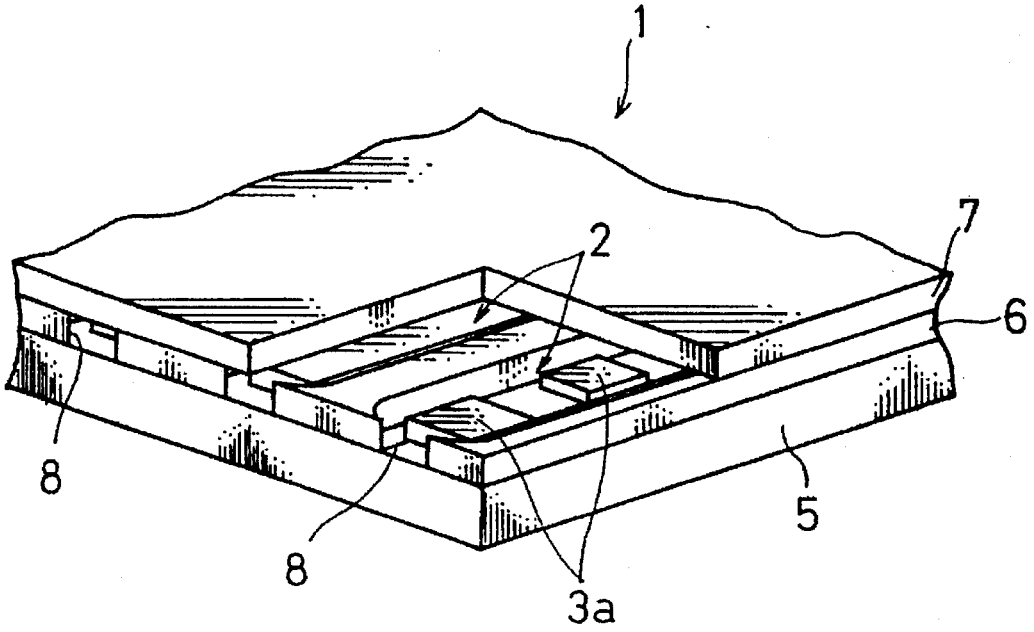
FIG. 1(*a*) is a perspective view of an ink head main body of an ink jet head.
Figure 1:
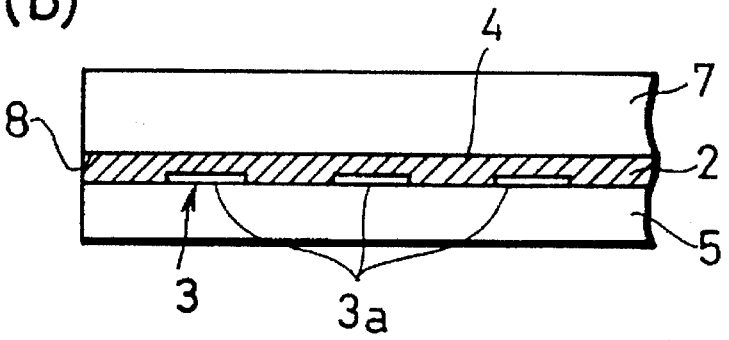

As illustrated in FIGS. 1(*a*) and 1(*b*), an ink jet head of the present embodiment has an ink head main body 1 that is comprised of a substrate 5 whereon a plurality of piezoelectric devices 3*a* are formed, spacers 6 that are formed on one surface of the substrate 5, and a roof plate 7 that is joined to the substrate 5 through the spacers 6. Here, the gap between the substrate 5 and the roof plate 7 is set to a value in the range of 1 to 100 μm. In the ink head main body 1, a plurality of ink passages 2 are independently formed between the substrate 5 and the roof plate 7, and orifices 8, which function as nozzles for spraying ink 4 flowing through the ink passages 2, are formed at respective top portions of the ink passages 2. Further, as will be described later, rows 3 of piezoelectric devices, each of which is made of a plurality of piezoelectric devices 3*a*, are formed along the respective ink passages 2. Thus, a head device, which constitutes one ink-spraying unit, is made of each orifice 8, each ink passage 2, and each row 3 of the piezoelectric devices. Moreover, an ink supply section, not shown, is connected to the present ink head main body 1 through the end portions of the respective ink passages 2, and the ink supply section is commonly used by the respective ink passages 2.

Figure 2:
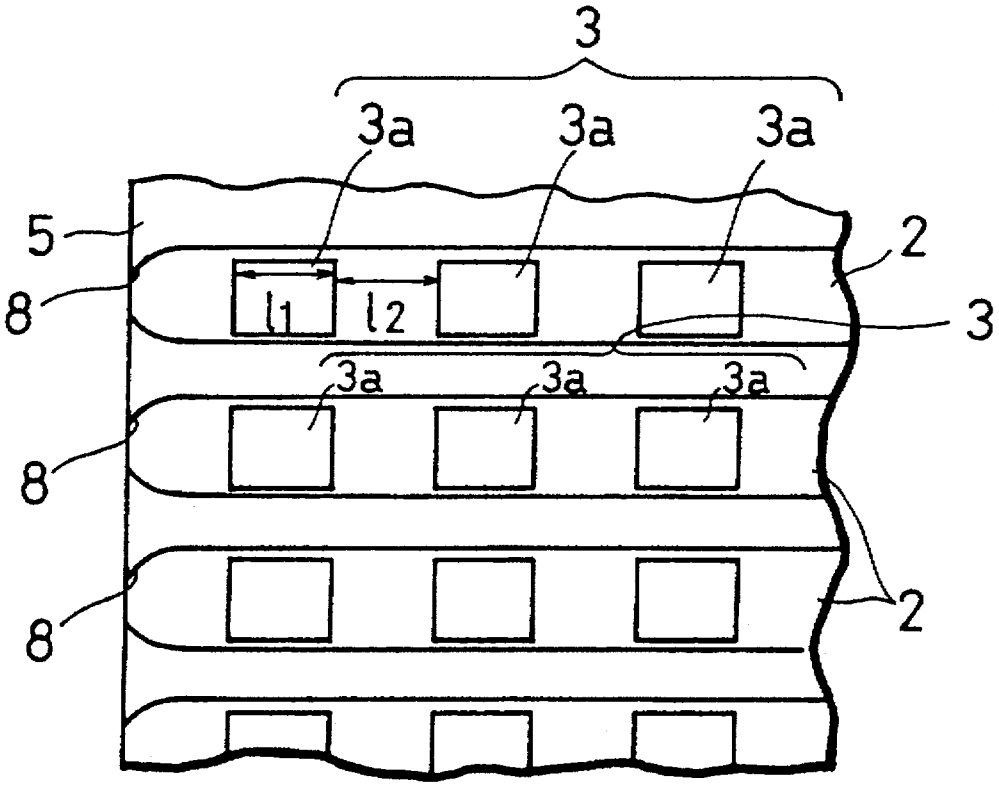
FIG. 2 is a plan view showing a substrate whereon ink passages and rows of piezoelectric devices are formed in the ink head main body.

As illustrated in FIG. 2, those piezoelectric devices 3*a*, which are provided on the substrate 5, form each row 3 of piezoelectric devices along each ink passage 2. Here, the piezoelectric devices 3*a* are classified into the first group of piezoelectric devices and the second group of piezoelectric devices, as will be described below.

More specifically, the piezoelectric devices 3*a* in each row 3 of piezoelectric devices are alternately designated as the first group of piezoelectric devices and as the second group of piezoelectric devices. For example, the arrangement is made in the following order from the closest side of the orifice 8: the first group of piezoelectric devices, the second group of piezoelectric devices, the first group thereof, the second group thereof, . . .

In the above arrangement, ac voltages, which have phases that are different from each other by 90 degrees, are respectively applied to the first group of piezoelectric devices and the second group of piezoelectric devices of each row 3 of piezoelectric devices by lower and upper electrode sections, not shown. Additionally, such applications of the ac voltages are controlled for each row 3 of piezoelectric devices; therefore, the ac voltages are applied to a row 3 of piezoelectric devices that belongs to a desired ink passage 2 only at the time when a spraying operation of ink particles is required.

Further, the length $l_1$ in the flowing direction of each piezoelectric device 3*a* and the distance $l_2$ between the adjacent piezoelectric devices 3*a* are set to be equal to each other.

Figure 3:
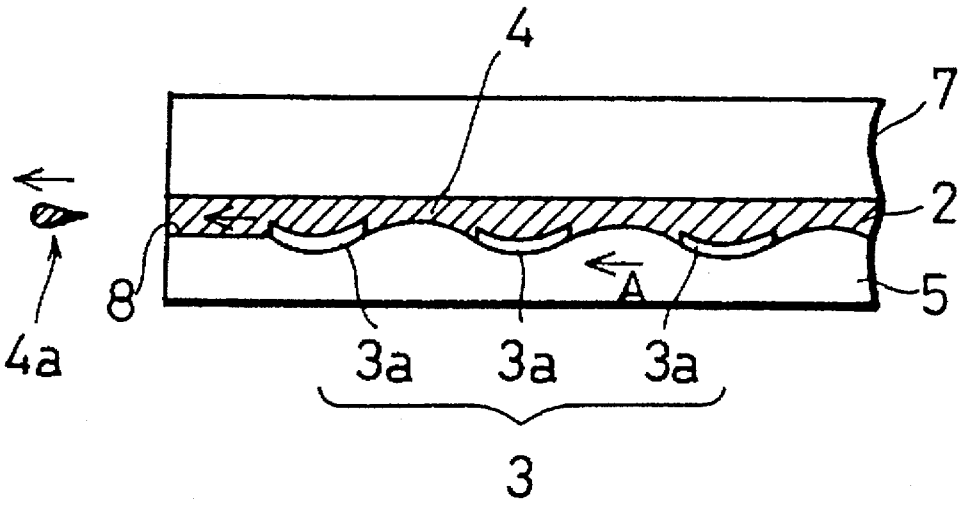
FIG. 3 is an explanatory view showing a state wherein the ink head main body is in operation.
Figure 4A:
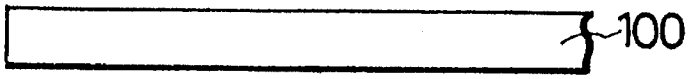
FIGS. 4(*a*) through 4(*h*) are vertical sectional views showing a manufacturing process of the ink head main body.
Figure 4B:
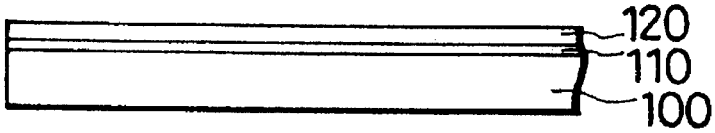
Figure 4C:
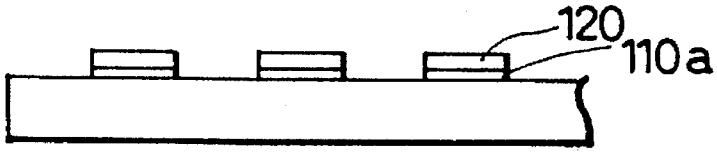
Figure 4D:
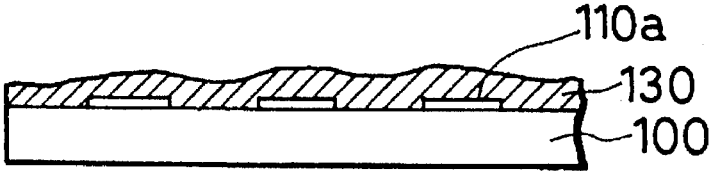
Figure 4E:
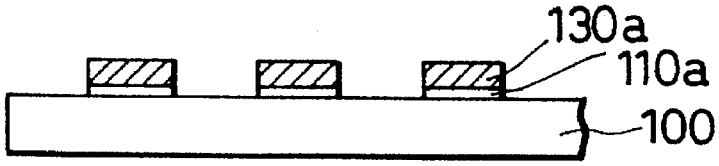
Figure 4F:
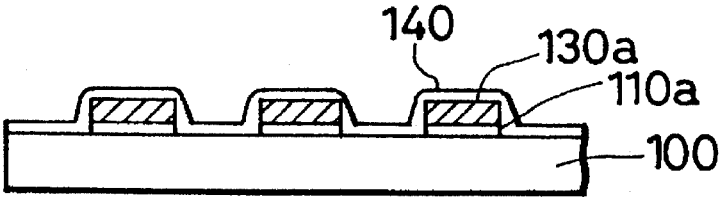
Figure 4G:
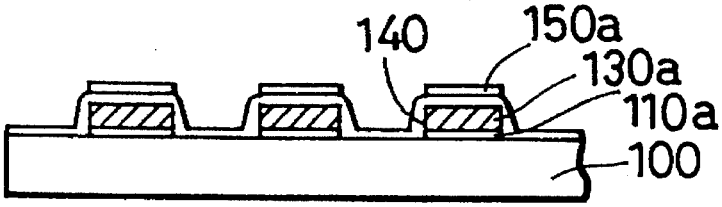
Figure 4H:
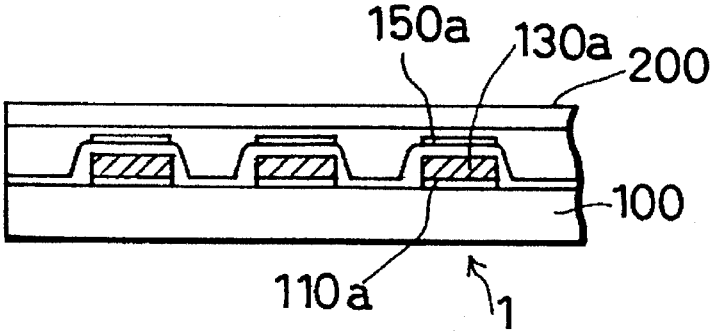

For example, as illustrated in FIG. 3, in the ink jet head having the above construction, if voltages whose phases are controlled as described above are applied to the piezoelectric devices 3*a* of the row 3 of piezoelectric devices that belong to a certain ink passage 2, progressive waves are excited in the ink 4 that is stored inside the ink passage 2 by the row 3 of piezoelectric devices. The progressive waves proceed in the flowing direction indicated by an arrow A toward the nozzle. Here, the proceeding direction of the progressive waves may be changed by using the advance and delay of the phases in accordance with a method described in the Technical Report of IEICE, US86-16, pp 23–30 and other methods. When such progressive waves are excited, the progressive waves impart a velocity in the arrow A direction to the ink 4 that is in contact with the row 3 of piezoelectric devices. Thus, the ink 4 is led to the ink passage 2, and moved toward the orifice 8, and then allowed to be sprayed from the orifice 8 as ink particles 4*a*. The sprayed ink particles 4*a* adhere to a sheet of paper, not shown, that is located in front of the orifice 8, thereby forming recorded dots on the sheet of paper. Additionally, in this case, the ink 4 is successively supplied to the ink passage 2 from the ink supply section, not shown.

Therefore, in the ink jet head of the present embodiment, even if bubbles enter the ink passage 2, the bubbles are carried following the flow of the ink 4, and discharged from the orifice 8; this prevents the bubbles from interfering with the spray of the ink 4, which makes the present construction different from conventional constructions. Thus, it becomes possible to obtain an ink jet head having high reliability.

Moreover, the present construction is provided with the ink passage 2 and the orifice 8; therefore, different from conventional arrangements, this construction allows the ink 4 to be led to the orifice 8 accurately as well as easily, and also allows the ink particles 4*a* to reach and adhere to a desired printing position accurately as well as easily. Therefore, it is not necessary to provide preparatory work for adjusting factors such as the moving direction of ink 4 and the moving direction of ink particles 4*a* in accordance with the quantity and properties of the ink 4.

Further, different from the conventional usage of piezoelectric devices, the above rows 3 of piezoelectric devices are not used to change the volume of the ink storage section, but instead used to excite progressive waves. For this reason, it is not necessary for the piezoelectric devices to have a size large enough to fit the volume of the ink storage section, as is required in conventional arrangements. In addition, the ink jet head of the present embodiment has such a simple construction as described above. Therefore, without the necessity of machining processes, the ink jet head of the present embodiment can me produced in a large quantity through a batch process by adopting a fine machining technique such as the etching method. This makes it possible to miniaturize the ink jet head with a high degree of integration as well as to reduce the cost of production.

Additionally, it is not necessary to provide the substrate 5, the roof plate 7, and the spacers 6 as separated members, and some of them or all of them may be integrally formed into one part. This makes the construction simpler, as well as simplifying the manufacturing process more effectively.

Next, an explanation will be given on a manufacturing process of the ink head main body 1 of the ink jet head wherein the etching method is employed. Here, as described above, the roof plate and the spacers are integrally formed into one part.

Figure 5A:
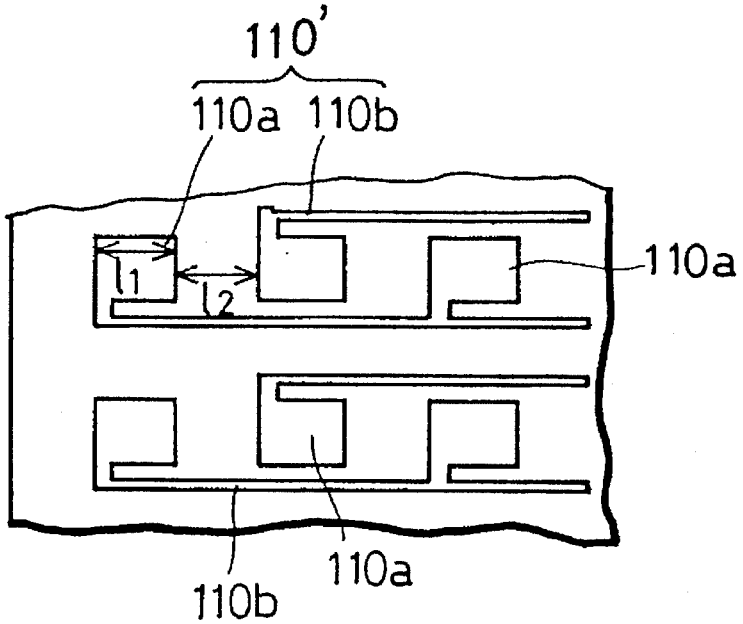
FIG. 5(*a*) is a plan view showing a pattern of electrodes for driving rows of piezoelectric devices that are installed in the ink head main body.
Figure 5B:
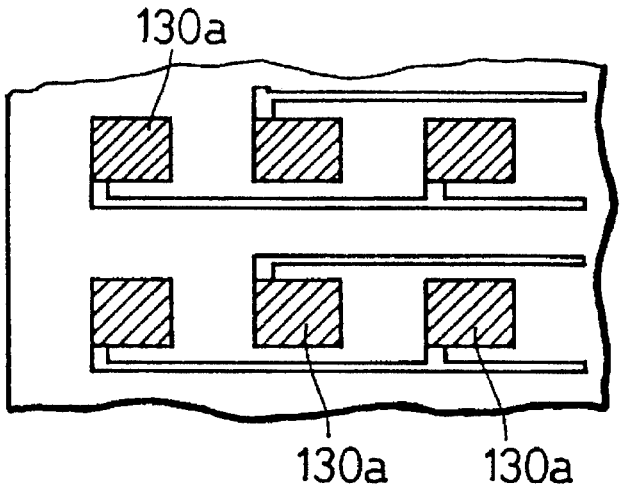
Figure 6:
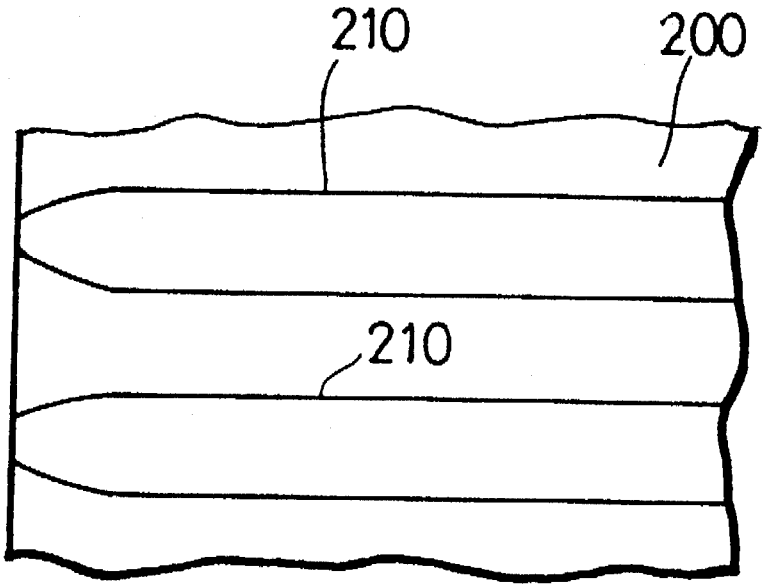
FIG. 6 is a bottom view showing a joined surface between roof plates and a substrate.
Figure 7A:
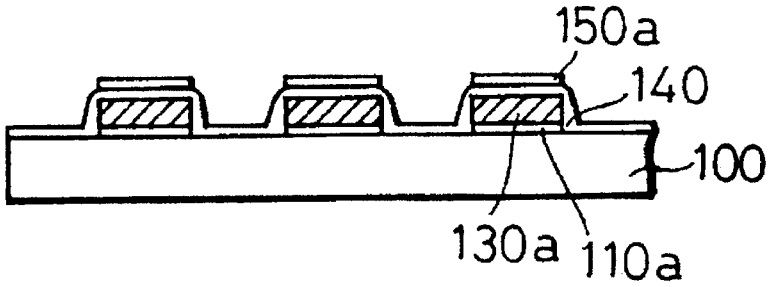
FIGS. 7(*a*) through 7(*d*) are vertical sectional views showing another manufacturing process of the ink head main body.
Figure 7B:
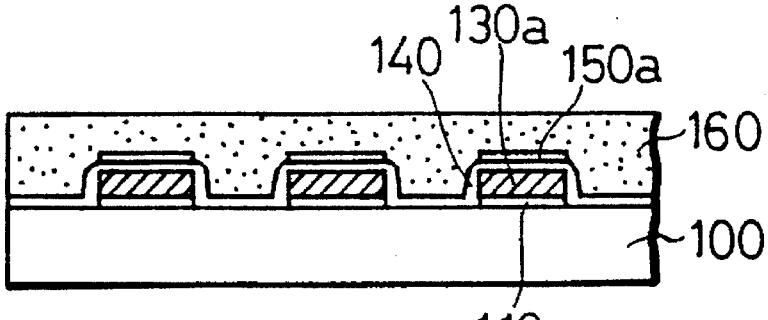
Figure 7C:
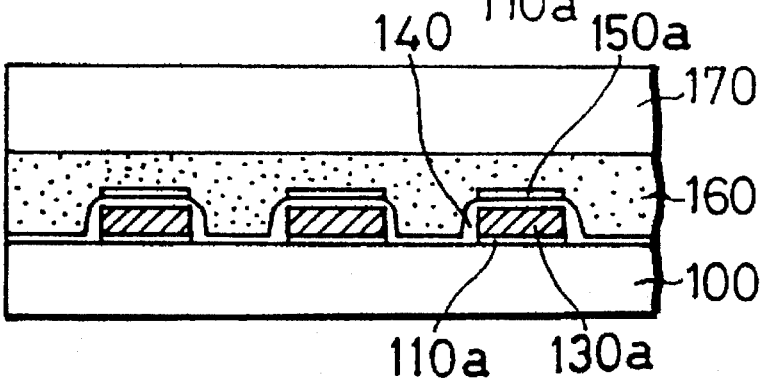
Figure 7D:
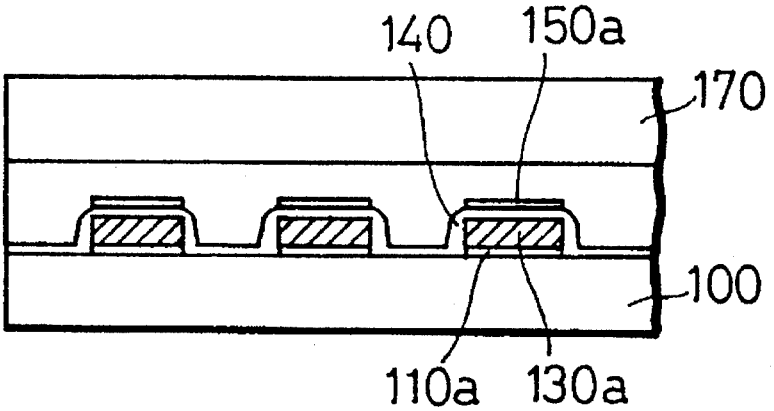

Referring to FIGS. 4 through 6, the following description will discuss the first manufacturing process.

FIGS. 4(*a*) through 4(*h*) are schematic side views showing processes through which one ink passage 2 is formed, and ink 4 is supposed to flow leftward in the drawings. Further, FIGS. 5(*a*) and 5(*b*) are schematic plan views showing processes through which rows of piezoelectric devices are formed by arranging piezoelectric devices laterally in the drawings, and the ink 4 is supposed to flow leftward also in these drawings.

As illustrated in FIG. 4(*a*), a substrate 100, which is made of glass, ceramic, metal, or other materials, is first prepared, and a metal film 110, made of Al, Cr, Mo, Ta, Co, Ni or an alloy of some of these metals, is formed on the substrate 100. To this is applied photoresist 120 as illustrated in FIG. 4(*b*), and an electrode pattern, such as shown in FIG. 5(*a*), is formed therein by means of photolithography. Then, excess portions of the metal film 110 are removed by applying etching thereto, as illustrated in FIG. 4(*c*), and lower electrode sections 110', each of which consists of a lower electrode 110*a* and a lower wiring section 110*b*, are formed as illustrated in FIG. 5(*a*). Here, in each lower electrode 110*a*, the length $l_1$ of the lower electrode 110*a* is set to be equal to the distance $l_2$ between the adjacent lower electrodes 110*a*. Further, the lower wiring sections 110*b* are designed so that ac voltage of the same phase is applied to every other lower electrode 110*a* in the lateral direction.

Next, as illustrated in FIG. 4(*d*), on the substrate 100 wherein the lower electrode sections 110' are formed, is formed a piezoelectric film 130 that is made of PZT(PbO-$ZrO_2$-$TiO_2$), PLZT(PbO-$La_2O_3$-$ZrO_2$-$TiO_2$), ZnO, AlN or other materials. As to the manufacturing method of the piezoelectric film 130, various methods such as the vacuum evaporation method, the sputtering method, the CVD method, and the sol-gel method may be employed. In addition to these methods, it is possible to employ the so-called green sheet method wherein a material in slurry state mixedly containing powder of piezoelectric material, binder, and appropriate solvents is thinly coated. Here, the vacuum evaporation method, the sputtering method, the CVD method, and the sol-gel method are well suited for forming a piezoelectric film 130 having a thickness of 0.1 to several μms, while the green sheet method is suited for forming a film having a thickness of more than those values.

Next, as with the metal film 110, a pattern is formed in the piezoelectric film 130 by means of photolithography so that only the portions indicated by slanting lines in FIG. 5(*b*) are left, and piezoelectric devices 130*a* are formed on the lower electrodes 110*a* by applying etching thereto, as illustrated in FIG. 4(*e*).

Then, as illustrated in FIG. 4(*f*), an insulating film 140, which is made of an inorganic material such as SiO, $SiO_2$, SiN, and AlN, or an organic material such as parylene resin and polyimide resin, is formed to cover the entire surface of the substrate 100.

Thereafter, as illustrated in FIG. 4(*g*), on this insulating film 140, are formed upper electrodes 150*a* that have the same shape as the lower electrodes 110*a* and wiring sections, not shown, in the same method as described earlier. In this case, the insulating film 140 is located between the wiring sections attached to the upper electrodes 150*a* and the lower wiring sections 110*b*; this prevents electrical shorts that might occur between both sections. Moreover, pads having different shapes may be installed at each wiring section of the upper electrode 150*a* and at the foot of each lower wiring section 110*b*, and signal lines for supplying driving voltage may be attached to the pads by means of wire bonding.

FIG. 6 is a schematic bottom view showing the roof plate 200 that is joined to the substrate 100, and ink is supposed to flow leftward in this drawing.

The roof plate 200 is made of glass, ceramic, metal or other materials, and recessed sections 210, which have a shape corresponding to each ink passage 2 and each orifice 8, are formed on one side of the roof plate 200 by means of etching. Then, as illustrated in FIG. 4(*h*), the substrate 100 and the roof plate 200 are joined together so that the processed surface of the substrate 100 and the processed surface of the roof plate 200 are aligned face to face with each other. In this manner, the ink jet main body 1 of FIG. 1 is manufactured.

Figure 8:
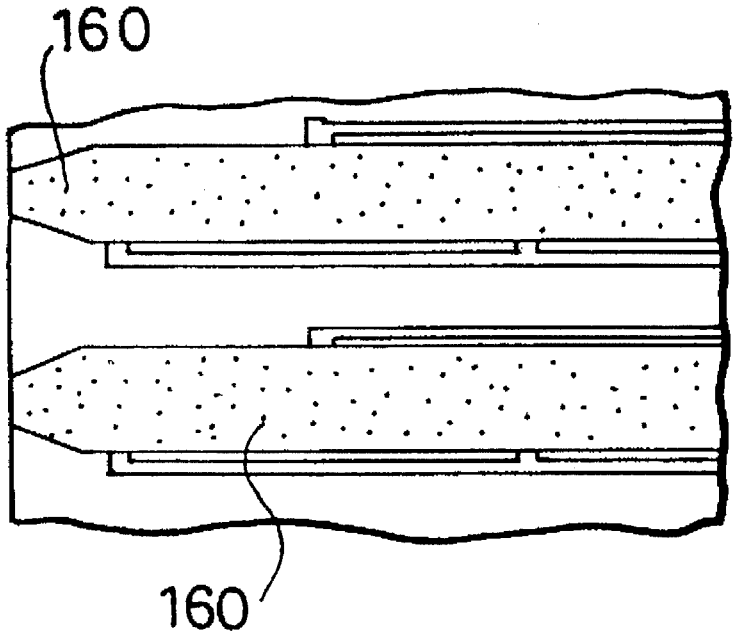
FIG. 8 is a plan view showing a processed surface of the substrate.

Referring to FIGS. 7(*a*) through 7(*d*) as well as FIG. 8, the following description will discuss the second manufacturing process. As with the case described earlier, FIGS. 7(*a*) through 7(*d*) are schematic side views showing processes through which one ink passage 2 is formed, and ink 4 is supposed to flow leftward in the drawings. Further, as with the case described earlier, FIGS. 8 is a schematic plan view showing processes through which rows of piezoelectric devices are formed by arranging piezoelectric devices laterally in the drawings, and the ink 4 is supposed to flow leftward also in this drawing.

As illustrated in FIG. 7(*a*), following the same processes as those used in the first manufacturing process, lower electrodes 110*a*, piezoelectric devices 130*a*, an insulating film 140, upper electrodes 150*a*, etc. are formed on the substrate 100.

Next, on this is formed a sacrifice layer 160 which is made of a sublimated material such as PSG(Phospho-Silicate Glass) and stylene resin, or a polymeric material that is soluble in organic solvents. Then, as illustrated in FIG. 8, the sacrifice layer 160 is formed into a shape that corresponds to the shape of each ink passage 2 and each orifice 8 that are to be made. Further, as illustrated in FIG. 7(*b*), the sacrifice layer 160 is processed to have a thickness equal to the height of the ink passage 2 that is to be finally made.

Thereafter, as illustrated in FIG. 7(*c*), a roof plate 170, which has a thickness that is enough to maintain appropriate mechanical strength, is formed to cover the upper surface of the sacrifice layer 160 and the upper surface of the substrate 100. As to the materials of the roof plate 170, various materials, such as polysilicon, AlN, SiO, $SiO_2$, low-melting-point glass, PZT, PLZT, ZnO, TiO, photo-hardening resin, and other ceramic materials, may be employed. As to the manufacturing methods of the roof plate 170, if materials such as polysilicon, AlN, SiO, and $SiO_2$ are selected to form the roof plate 170, the vacuum evaporation method, the CVD method, or the sputtering method may be adopted; if materials such as PZT, PLZT, ZnO, and TiO are selected, the sputtering method or the sol-gel method may be adopted. Further, if ceramic materials are selected, it is possible to employ the so-called green sheet method wherein a material in slurry state mixedly containing powder of piezoelectric material, binder, and appropriate solvents is thinly coated.

Lastly, as illustrated in FIG. 7(*d*), the sacrifice layer 160 is removed. In this manner, the ink head main body 1 of FIG. 1 is manufactured. As to the removing methods of the sacrifice layer 160, although they are different depending on the material forming the sacrifice layer 160, methods using a predetermined etching liquid or organic solvents may be adopted. In the case of the sublimated materials, the removing process is performed by heating the entire construction.

The following description will discuss the above manufacturing processes. Both the first and second processes make it possible to form fine ink passages 2 with high accuracy by the etching method, thereby manufacturing a compact ink jet head with a high degree of integration.

Further, by adopting the etching method, it becomes possible to manufacture the apparatuses in a large quantity through a batch process; this results in reduction in the manufacturing cost.

Moreover, the ink passages 2 are shaped to have a precise depth by adopting the etching method in forming the ink passages 2; therefore, it is possible to accurately determine the distance between the surface of progressive waves and the roof plate 7, which forms an important factor upon exciting progressive waves.

Furthermore, in the second manufacturing process, the height of the ink passages 2 is set to be equal to the thickness of the sacrifice layer 160 that is preliminarily formed and processed; this results in an advantage wherein the height adjustment is performed more easily than that of the first manufacturing process.

In both of the manufacturing processes, the orifices 8 are formed by providing a pattern wherein each passage narrows at one end and applying etching thereto; yet, it is possible to adopt another method wherein, for example, orifice plates, which are made of another material and are manufactured by applying a fine perforating process to Ni plates or other members that are formed through electrocasting, are joined to the corresponding installation positions of the orifices 8.

Moreover, as to the shapes of the rows 3 of piezoelectric devices for exciting progressive waves and the upper and lower electrode sections, which are featured in the present invention, it is possible to adopt other various shapes instead of the aforementioned shapes.

Furthermore, in the ink jet head of the present embodiment, the rows 3 of piezoelectric devices are installed on the substrate 5 of the ink head main body 1; yet, the present invention is not intended to be limited to this construction. It is possible to adopt another construction wherein, for example, the rows 3 of piezoelectric devices are installed on the roof plate 7.

Figure 9A:
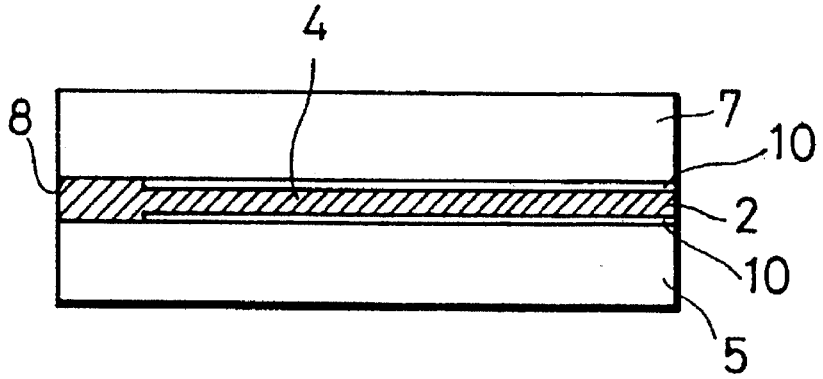
FIG. 9(*a*) is a vertical sectional view of the ink head main body.
Figure 9B:
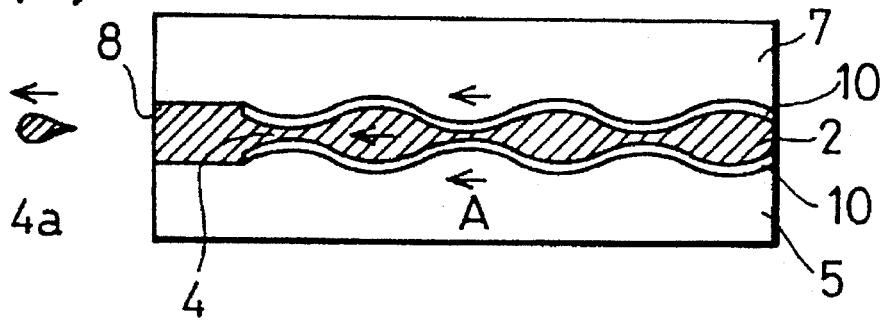

Besides the above constructions, it is possible to adopt another construction wherein rows 10 of piezoelectric devices are installed on both of the substrate 5 and the roof plate 7, as is illustrated in FIG. 9(*a*). In the drawing, the shape of the rows 10 of piezoelectric devices is shown rather schematically because the shape is not necessarily limited to the shape of the aforementioned embodiment. In an ink jet head having such a construction, upon spraying ink particles 4*a*, progressive waves are excited by the rows 10 of piezoelectric devices that are installed on both the upper and lower surfaces, as is illustrated in FIG. 9(*b*). This construction makes it possible to increase the velocity of the ink 4 upon flowing, thereby improving the spraying efficiency.

Moreover, since the progressive waves are excited from both the upper and lower surfaces, this construction prevents the progressive waves from contacting one surface that faces the surface from which the progressive waves are excited, and wearing this opposite surface; this makes it different from the construction where progressive waves are excited from one side. Thus, this construction makes it possible to improve the efficiency of the progressive waves in imparting the velocity to the ink 4, as well as to ensure long life for the ink jet head.

[Embodiment 2]

Figure 10:
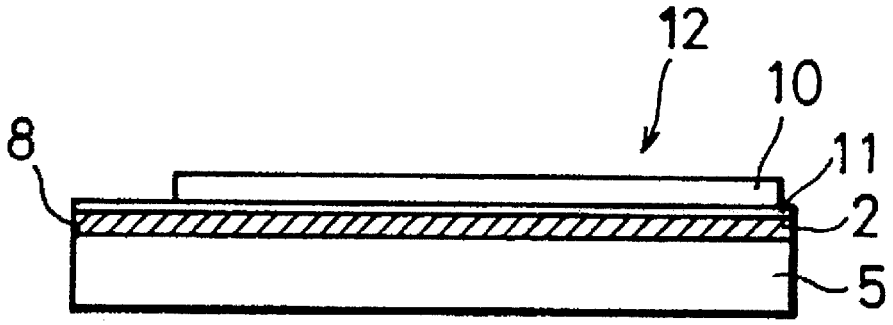
FIG. 10 is a vertical sectional view showing an ink head main body of another embodiment of the present invention.

Referring to FIG. 10, the following description will discuss another embodiment of the present invention. Here, for convenience of explanation, those members that have the same functions and that are described in the aforementioned embodiment are indicated by the same reference numerals and the description thereof is omitted.

As illustrated in FIG. 10, the ink jet head of the present invention has an ink head main body 12 wherein a diaphragm 11 is formed on a substrate 5 with spacers, not shown, sandwiched in between. In order to provide the diaphragm 11, for example, a method of processing stainless steel or Si monocrystal by means of anisotropic etching may be employed. In this case also, although not shown in FIG. 10, a plurality of ink passages 2 are independently formed on the substrate 5 in the same manner as described in the embodiment 1. Here, the height of the spacers that are disposed between the substrate 5 and the diaphragm 11 in the ink head main body 12 is set to be equal to the height of the ink passages 2 so that the ink passages 2 are formed between the diaphragm 11 and the substrate 5.

Along the passages, a plurality of rows 10 of piezoelectric devices are formed on the diaphragm 11 at the positions corresponding to the ink passages 2.

Therefore, when ink 4 moves through the ink passages 2, the ink 4 does not directly contact the rows 10 of piezoelectric devices. Therefore, even in the case of using ink 4 of corrosive type, it is possible to prevent the ink 4 from damaging the rows 10 of piezoelectric devices.

As with the aforementioned embodiment 1, the ink jet head of the present embodiment is also produced through a batch process that uses the etching method.

[Embodiment 3]

Figure 11:
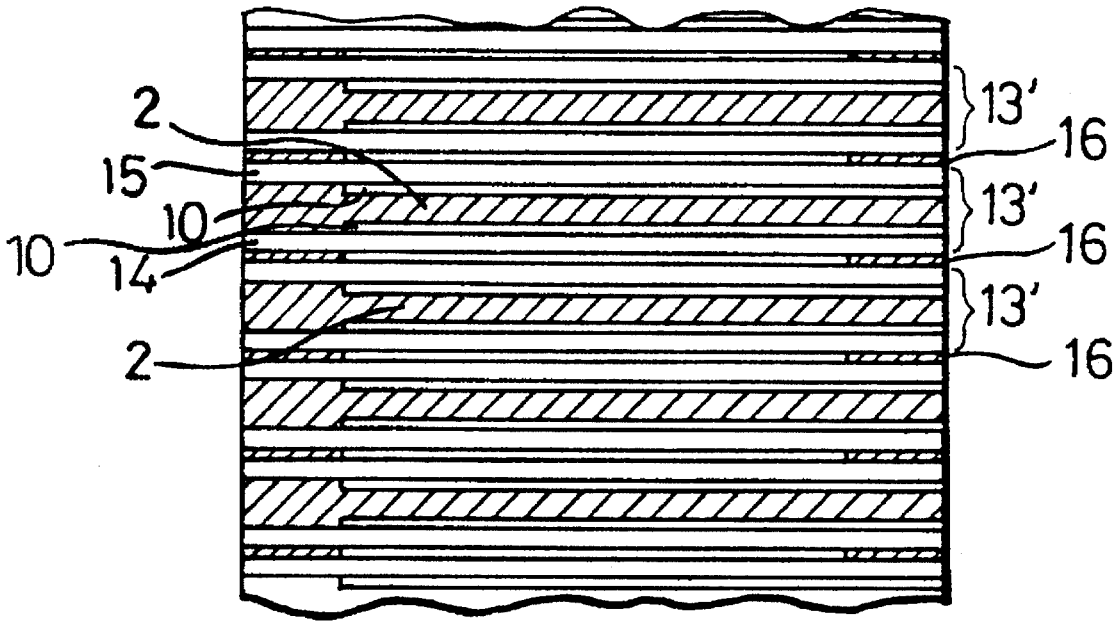
FIG. 11 is a vertical sectional view showing an ink head main body of still another embodiment of the present invention.
Figure 12:
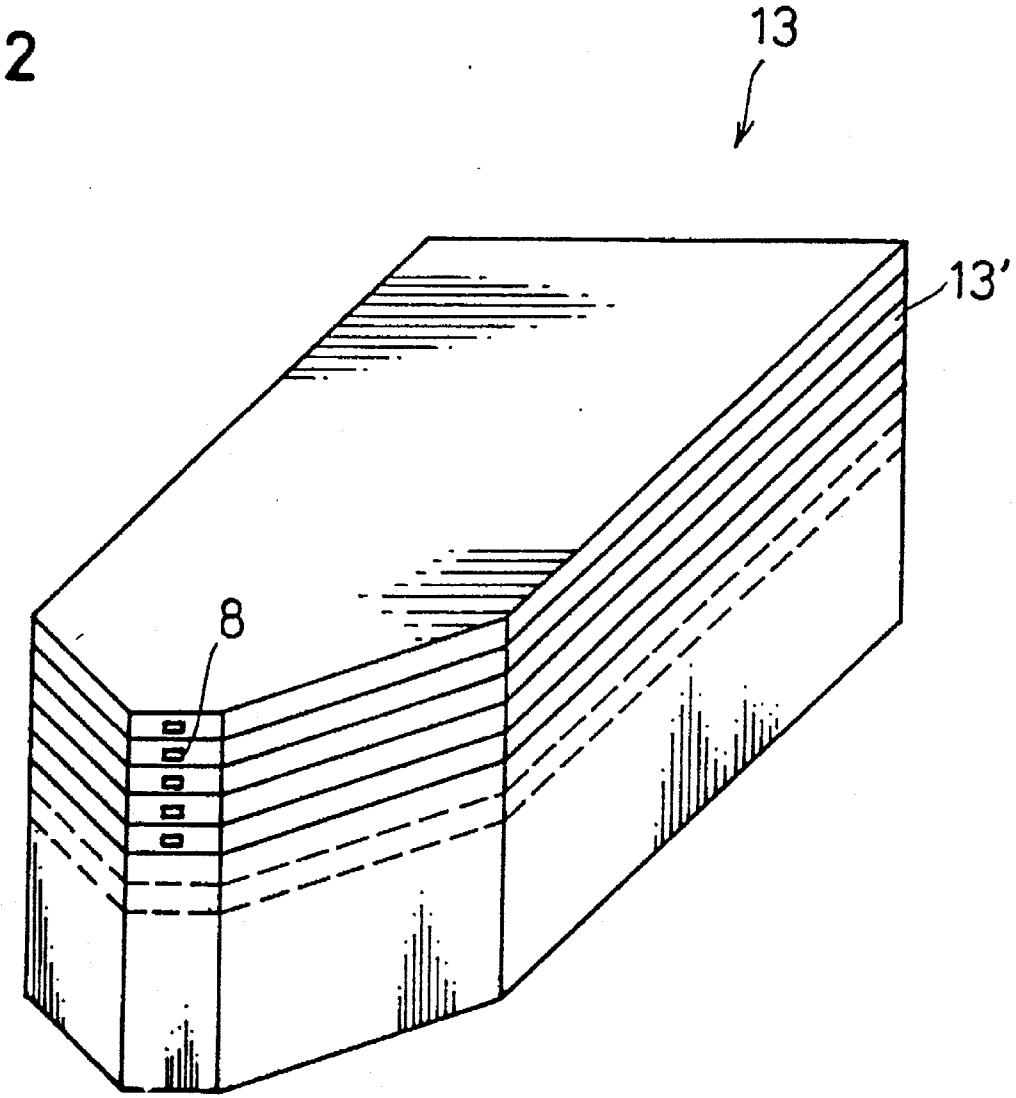
FIG. 12 is a perspective view showing the external appearance of the ink head main body shown in FIG. 11.
Figure 13:
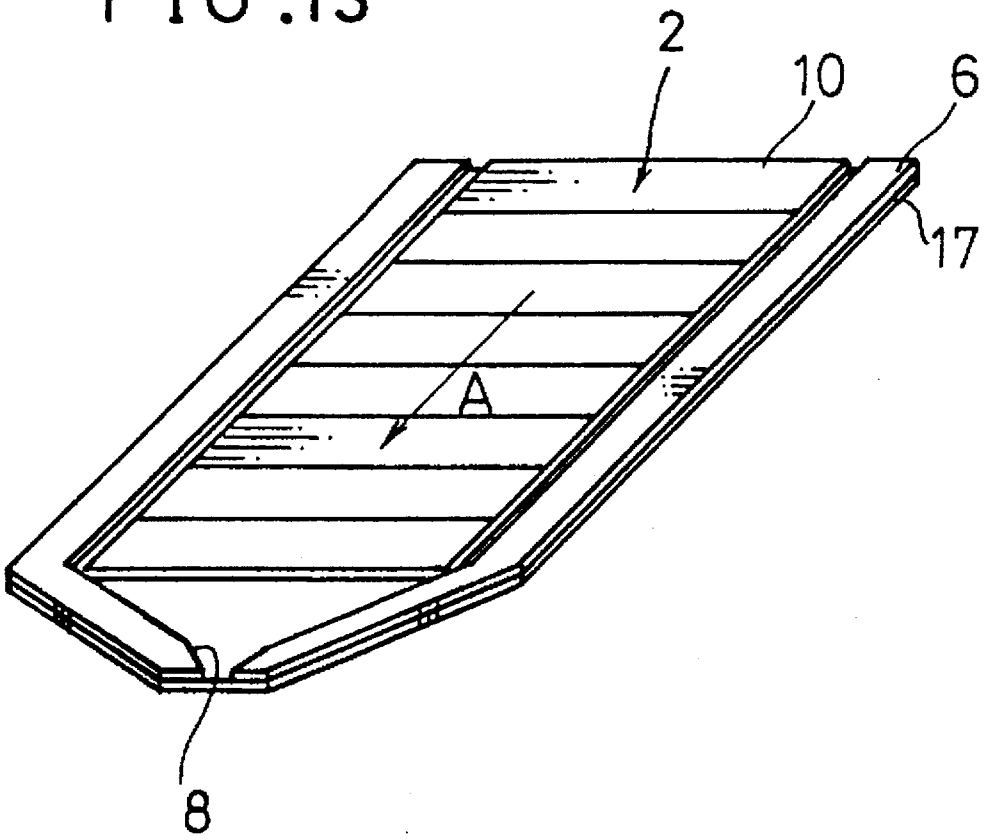
FIG. 13 is a perspective view showing a processed surface of the substrate that constitutes the ink head main body.

Referring to FIGS. 11 through 13, the following description will discuss still another embodiment of the present invention. Here, for convenience of explanation, those members that have the same functions and that are described in the aforementioned embodiment are indicated by the same reference numerals and the description thereof is omitted.

The ink jet head of the present embodiment is provided with an ink head main body 13 whose external appearance is shown in FIG. 12. As illustrated in FIG. 11, rows 10 of piezoelectric devices are installed on both sides of a substrate 14 and a roof plate 15, and one ink passage 2 is formed between the substrate 14 and the roof plate 15. Thus, a head device 13', which forms one ink-spraying unit, is comprised of an orifice 8, the ink passage 2, and the rows 10 of piezoelectric devices. Further, a plurality of the head devices 13' are joined together, and laminated in the direction of height of the ink passages 2, with spacers 16 sandwiched therebetween.

As with the aforementioned embodiments 1 and 2, the ink jet head of the present embodiment is also produced through a batch process that uses the etching method.

In ink jet heads having an arrangement wherein nozzles, which spray ink particles by using progressive waves excited in the ink passages, are aligned laterally, it is inevitable to narrow the width of an ink passage in the plane-direction that is orthogonal to the passage-direction when it is intended to narrow the intervals of the nozzles in order to achieve printing with high precision. In contrast, in order to spray ink efficiently, it is necessary to increase the velocity of ink at the proximity of the nozzle. In order to increase the velocity, it is necessary to excite fast progressive waves. Here, in the ink jet head of the present embodiment, the head devices 13' are laminated in the height-direction of the ink passages 2; therefore, the width of the ink passages 2 in the plane-direction that is orthogonal to the passage-direction has no relation with the intervals of the orifices 8. This makes it possible to determine the width of each ink passage 2 widely enough. For this reason, even if the velocity of progressive waves excited by the rows 10 of piezoelectric devices is low and the subsequent velocity of ink 4 is slow in the ink passage 2, the ink 4 obtains a sufficient velocity when it comes close to the orifice 8 because the passage is sufficiently narrowed in the proximity of the orifice 8. Therefore, even if the velocity of the excited progressive waves is low, the ink 4 is sprayed efficiently.

Additionally, in the ink jet head of the present embodiment, the arrangement is made by laminating the head devices 13', each of which has the rows 10 of piezoelectric devices that are installed on both the substrate 14 and the roof plate 15; yet, the present invention is not intended to be limited to this arrangement. It is possible to adopt another arrangement that is made by laminating head devices, each of which has the rows 10 of piezoelectric devices that are installed either on the substrate 14 or on the roof plate 15. In such an ink jet head, rows 10 of piezoelectric devices and an orifice 8 are formed on one surface of a substrate 17, for example, as shown in FIG. 13, and spacers 6, which has a height that is equal to the height of an ink passage 2, are fixed to the side faces of the same surface. Then, a plurality of the substrates 17 are successively joined together so that the processed surface of each substrate 17 faces the non-processed surface of another substrate 17, thereby forming an ink jet head.

[Embodiment 4]

Figure 14:
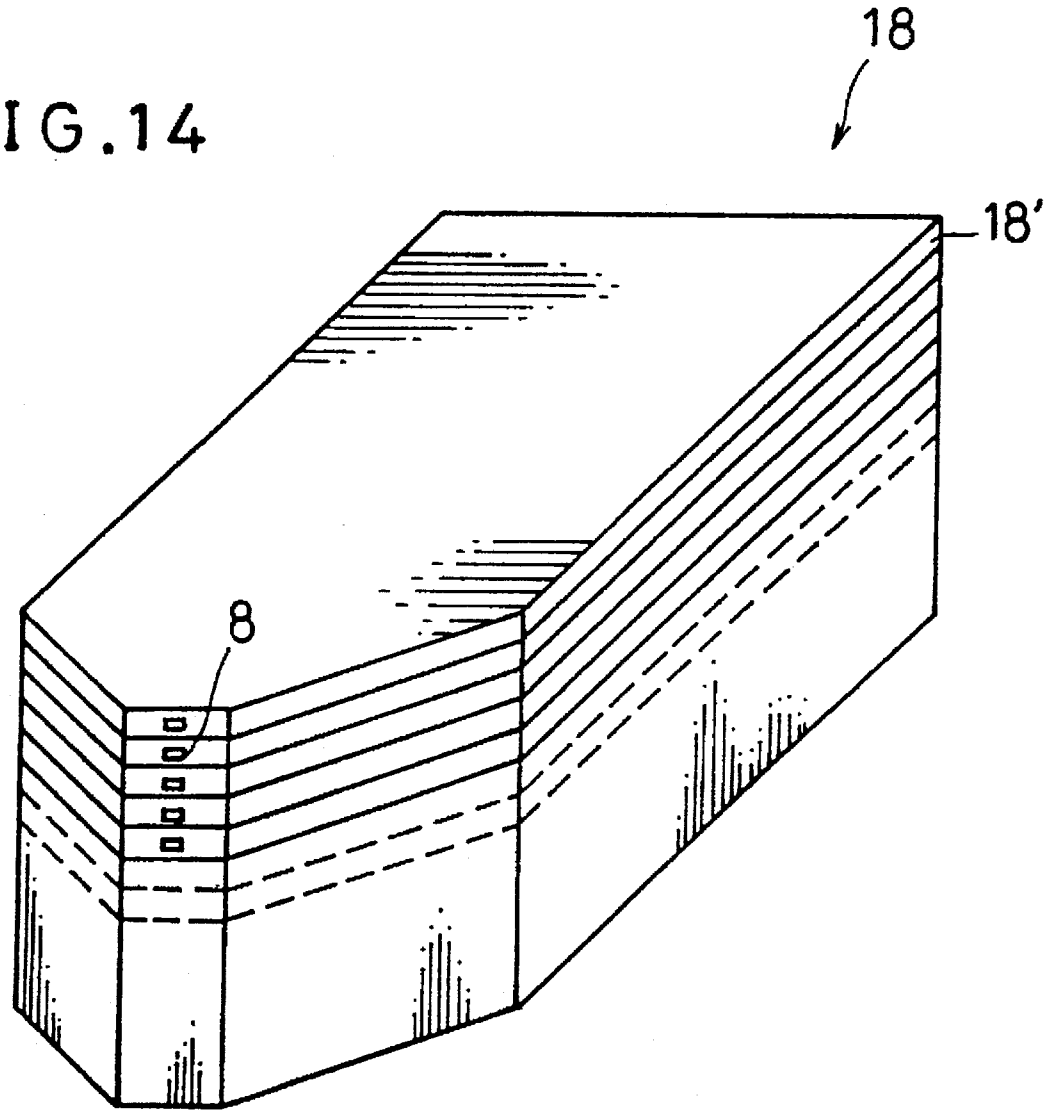
FIG. 14 is a perspective view showing the external appearance of an ink head main body in another embodiment of the present invention.
Figure 15:
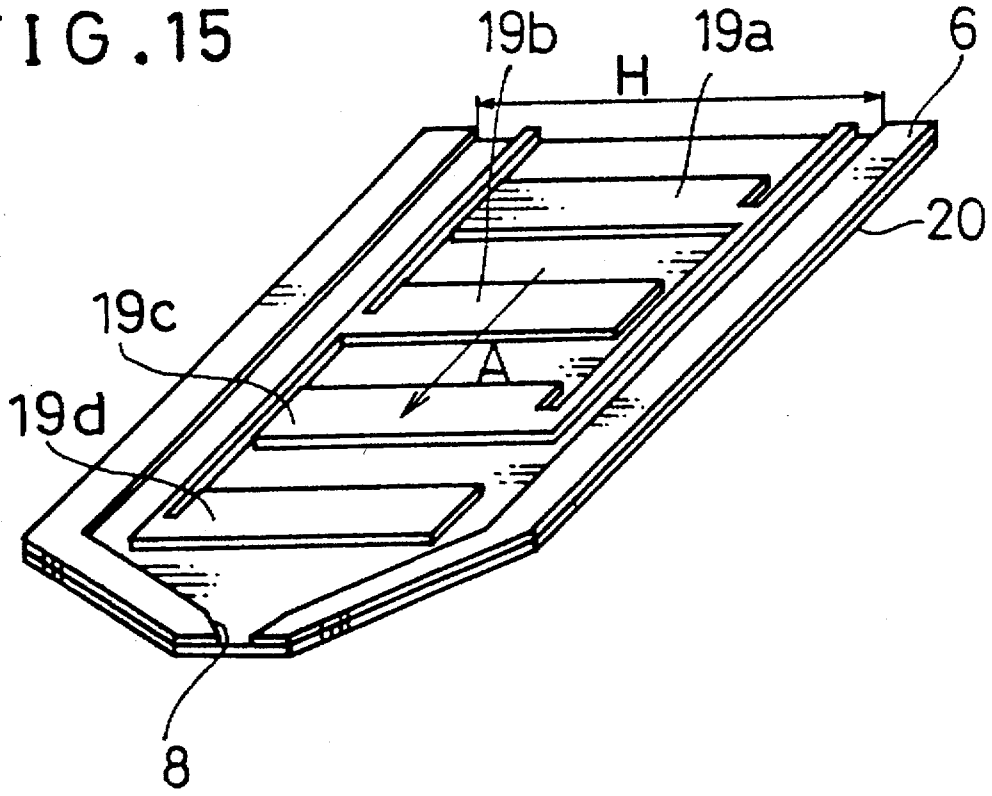
FIG. 15 is a perspective view showing a processed surface of the substrate that constitutes the ink head main body of FIG. 14.
Figure 16:
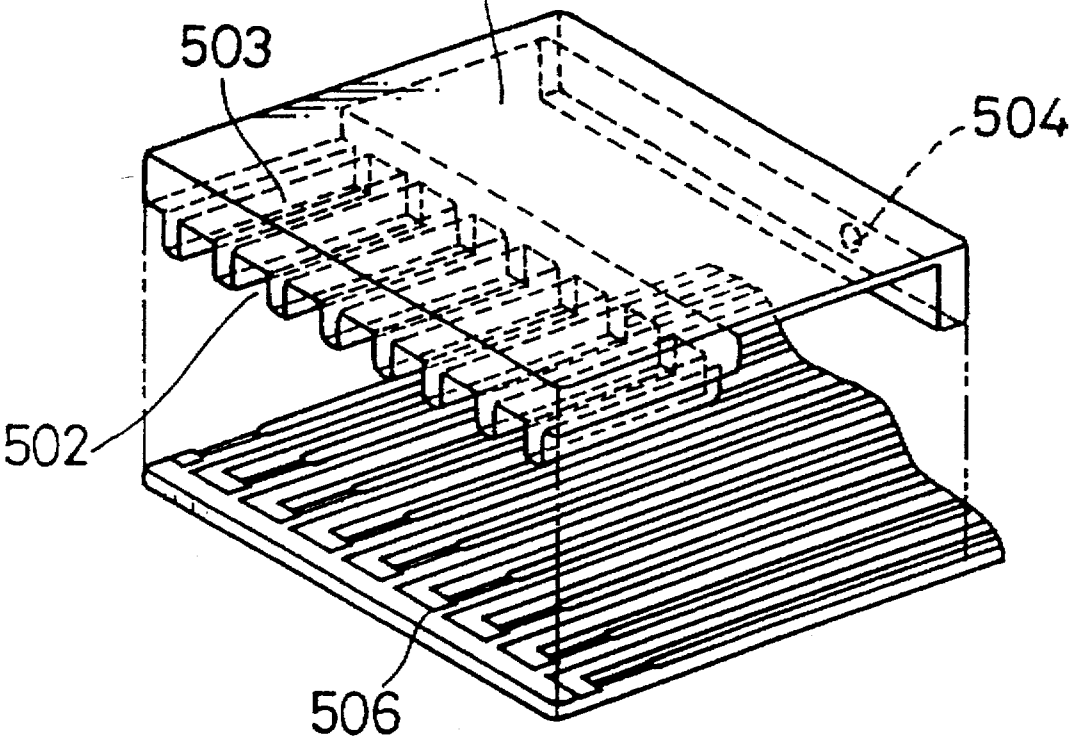
FIG.16 (PRIOR ART)
FIG. 16 is an explanatory drawing showing a construction of an ink head main body of the conventional thermal type.
Figure 17:
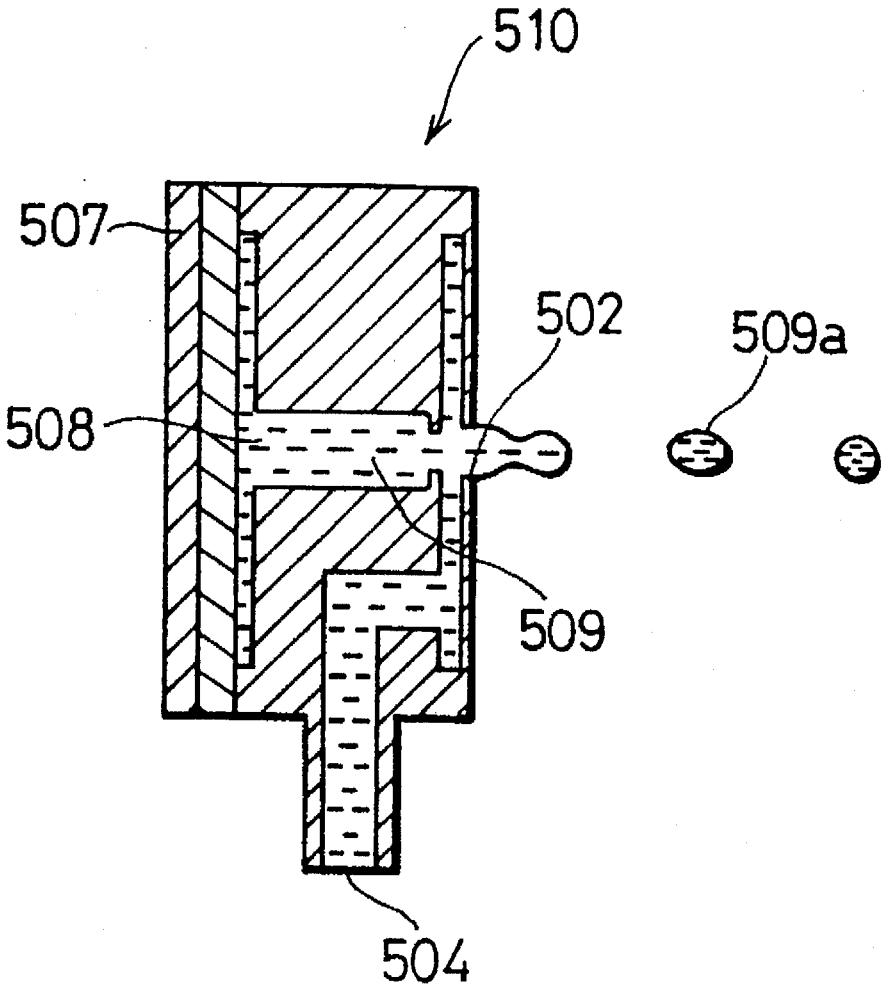
FIG.17 (PRIOR ART)
FIG. 17 is a vertical sectional view showing a construction of an ink head main body of the conventional piezoelectric type.

Referring to FIGS. 14 and 15, the following description will discuss still another embodiment of the present invention. Here, for convenience of explanation, those members that have the same functions and that are described in the aforementioned embodiment are indicated by the same reference numerals and the description thereof is omitted.

The ink jet head of the present embodiment is provided with an ink head main body 18 whose external appearance is shown in FIG. 14. As illustrated in FIG. 15, a film substrate 20, made up of a piezoelectric material film such as PVDF (poly vinylidene fluoride resin), is formed in the ink head main body 18. A plurality of electrode sections are formed on the upper surface of the film substrate 20, and they are classified into two types, that is, upper electrode sections **19*a* and 19*c* as well as upper electrode sections 19*b* and 19*d*, which are disposed one after another. Further, although not shown in FIG. 15, lower electrode sections, which have the same shapes as the upper electrode sections 19*a* and 19*c* as well the upper electrode sections 19*b* and 19*d*, are formed on the bottom surface of the film substrate 20 at positions corresponding to the upper electrode sections 19*a* and 19*c* as well as the upper electrode sections 19*b* and 19*d***.

Here, the upper electrode sections **19*a* and 19*c* and the corresponding lower electrode sections constitute the first electrode group, while the upper electrode sections 19*b* and 19*d*** and the corresponding lower electrode sections constitute the second electrode group.

In this arrangement, since the film substrate 20 is made of a piezoelectric material, the electrode sections that are disposed on the film substrate 20 form respective piezoelectric devices, and those piezoelectric devices form a row of piezoelectric devices. The piezoelectric devices are classified into the first group of piezoelectric devices and the second group of piezoelectric devices, which respectively correspond to the first electrode group and the second electrode group. Then, ac voltages, which have phases that are different from each other by 90 degrees, are respectively applied to the first electrode group and the second electrode group; this causes ac voltages whose phases are different from each other by 90 degrees to be respectively applied to the first group of piezoelectric devices and the second group of piezoelectric devices.

Additionally, the present embodiment exemplified a case wherein four electrode sections are used; yet, the number of the electrode sections is not intended to be limited to the above number.

Spacers 6 are attached to the side portions on the surface of the film substrate 20, and two film substrates 20 are joined face to face with each other with the spacers 6 sandwiched therebetween, thus forming a head device 18' which is one ink-spraying unit. Then, as illustrated in FIG. 14, a plurality of the head devices 18' are joined together, and laminated in the direction of height of the ink passages 2, with spacers, not shown, sandwiched therebetween, thus forming the ink head main body 18.

As with the aforementioned embodiments 1 through 3, the ink jet head of the present embodiment is also produced through a batch process that uses the etching method.

As with embodiment 3, in the ink jet head having the above arrangement, the width of the ink passages 2 in the plane-direction that is orthogonal to the passage-direction has no relation with the intervals of the orifices 8. This makes it possible to determine the width H of each ink passage 2 wide enough. Therefore, even if the velocity of the excited progressive waves is low, the ink 4 is sprayed efficiently in the same manner as the aforementioned embodiment 3.

Moreover, the substrate and the rows of piezoelectric devices are formed as integral parts of the same member by utilizing a piezoelectric material film made of PVDF or other materials; therefore, it becomes possible to reduce the thickness of one head device 18', thereby further miniaturizing the ink jet head.

The arrangement also makes it possible to narrow the intervals of the orifices 8, and to make records with high precision.

Moreover, since the piezoelectric devices are provided by simply forming the electrodes on both sides of the film, the production cost can be further reduced.

Figure 18:
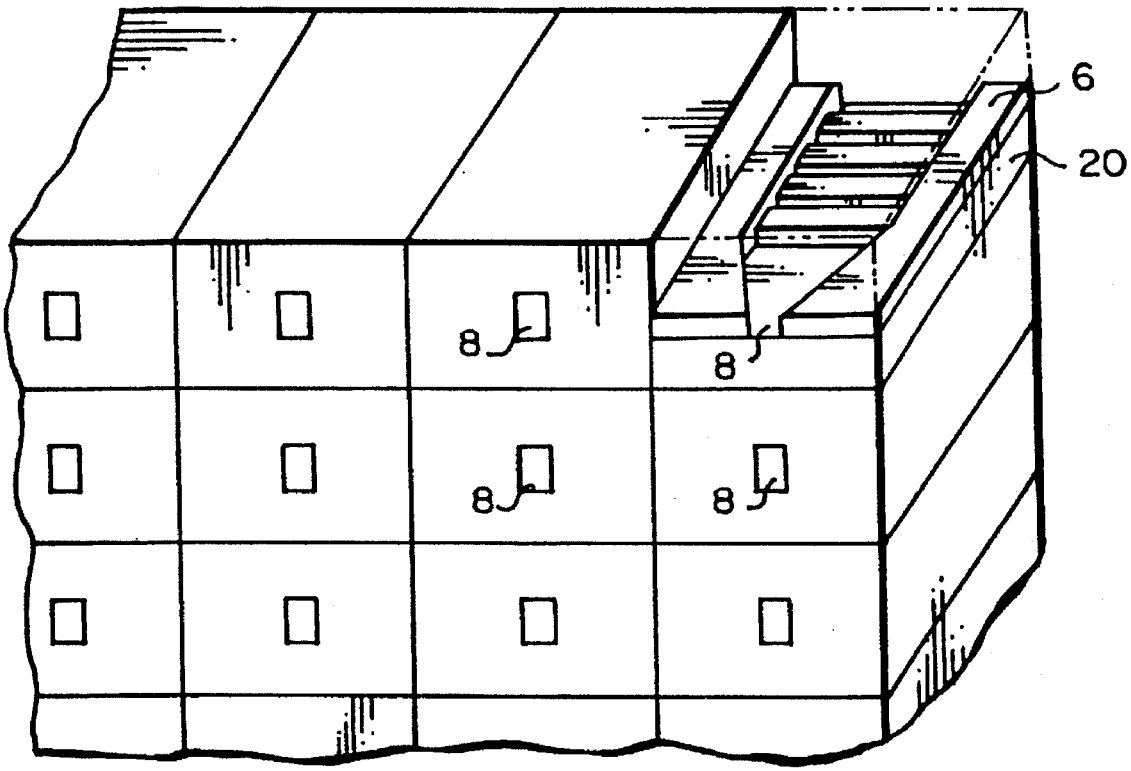
FIG. 18 is a perspective view showing an ink jet main body having two-dimensionally aligned orifices.

Furthermore, in addition to the ink jet head wherein the orifices 8 are linearly aligned, the present embodiment allows another arrangement wherein as illustrated in FIG. 18, the orifices 8 are two-dimensionally aligned; this results in high-speed printing.

Additionally, the present embodiment may be also applied to another arrangement wherein progressive waves are excited from one side of the ink passage 2.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ink jet head comprising:

a head device that forms an ink-spraying unit, the head device being comprised of:

a nozzle from which ink is sprayed;

an ink passage that is connected to the nozzle; and progressive-wave generating means, driven by ac voltages having different phases, for generating progressive waves in the ink inside the ink passage, which progressive waves impart a velocity to the ink in a direction of the progressive waves.

2. The ink jet head as defined in claim 1, wherein the progressive-wave generating means comprises:

a row of piezoelectric devices that includes a first group of piezoelectric devices and a second group of piezoelectric devices, each group having a plurality of piezoelectric devices, the row of piezoelectric devices being aligned in a direction along the ink passage; and electrode sections for applying the ac voltages whose phases are different from each other to the first and second group of piezoelectric devices respectively, whereby progressive waves are generated in the ink inside the ink passage by applying the ac voltages whose phases are different from each other to the first and second groups of piezoelectric devices respectively from the electrode sections.

* * * * *